United States Patent [19]

Kuboyama

[11] 4,319,408

[45] Mar. 16, 1982

[54] HEATING PROCESS AND ITS APPARATUS IN REDUCING AIR PRESSURE WITHIN A CHAMBER AT A BALANCED LEVEL

[76] Inventor: Nobuyoshi Kuboyama, 28-9-1, Shimomiyamori, Aza, Miyamori-mura, Kamihei-gun, Iwate-ken, Japan

[21] Appl. No.: 200,563

[22] Filed: Oct. 24, 1980

[30] Foreign Application Priority Data

| | | | |
|---|---|---|---|
| Jul. 10, 1980 | [JP] | Japan | 55-94631 |
| Jul. 10, 1980 | [JP] | Japan | 55-97630 |
| Sep. 22, 1980 | [JP] | Japan | 55-132065 |
| Sep. 22, 1980 | [JP] | Japan | 55-132066 |

[51] Int. Cl.[3] ..... F26B 3/28

[52] U.S. Cl. ..... 34/15; 34/92; 34/39; 126/247

[58] Field of Search ..... 34/92, 15, 218, 230, 34/201, 223, 224, 232, 39; 126/247

[56] References Cited

U.S. PATENT DOCUMENTS

| | | | |
|---|---|---|---|
| 1,684,627 | 9/1928 | Hope et al. | 34/92 |
| 3,140,929 | 7/1964 | Johanson | 34/92 |
| 3,467,179 | 9/1969 | Tevis et al. | 126/247 |
| 3,958,552 | 5/1976 | Lawler | 126/247 |

*Primary Examiner*—Larry I. Schwartz

*Attorney, Agent, or Firm*—Thomas R. Morrison

[57] ABSTRACT

This invention relates to a heating process and its apparatus in reducing air pressure within a chamber at a balanced level. The air within the sealed chamber is suctioned forcibly and discharged thereoutside by rotation of rotary means installed to the chamber. Then, the air pressure therewithin gets reduced at a balanced level. Meanwhile, air friction heat is generated by continuous rotation of the rotary means, thereby the inside of the chamber is heated by air friction heat. Any wet articles are incorporated in the chamber may be dried effectively, and energy consumption for heating and drying may be saved. Further, since high temperature heated air fully fills the chamber, the chamber itself may be used as a heat source.

11 Claims, 14 Drawing Figures

HEATING PROCESS AND ITS APPARATUS IN REDUCING AIR PRESSURE WITHIN A CHAMBER AT A BALANCED LEVEL

BACKGROUND OF THE INVENTION

This invention relates to a heating process and its apparatus in reducing air pressure at a balanced level. The air within the sealed chamber is suctioned forcibly and discharged thereoutside by rotation of rotary means installed in the chamber. Then, the air pressure therewithin gets reduced at a balanced level. On the other hand, an air friction heat is generated by continuous rotation of the rotary means, thereby the chamber inside is heated by the air friction. Various kinds of wet articles or wet products that are incorporated in the chamber may be dried effectively and speedily due to the air pressure reduction effect as well as the air friction heat effect.

When heating such a chamber and drying the wet articles incorporated therein, conventionally hot air has been supplied into the chamber by means of a pump for feeding the hot air. Or, a heat source such as oil, gas or a larger heating apparatus has been necessitated in order to heat the chamber inside.

Namely, for the purpose of drying the wet articles, energy for heating the inside of the chamber must be used in combination with a heat energy source for feeding the hot air. A great quantity of energy such as electric power, oil or gas has been wastefully consumed in order to operate the pump and the heating apparatus. The task of this invention is to remove the aforementioned disadvantages of the conventional art.

BRIEF SUMMARY OF THE INVENTION

Accordingly, it is a general object of this invention to provide a heating process and its apparatus in reducing air pressure within a chamber at a balanced level, wherein any wet articles incorporated in the chamber are heated and dried effectively without consuming energy wastefully. In a heating system of this invention, the air within the sealed chamber is suctioned forcibly and discharged thereoutside by rotation of rotary means installed in the chamber. On the other hand, air friction heat is generated by a continuous rotation of rotary means, thereby the inside of the chamber is heated by the air friction. Therefore, various kinds of wet articles such as agricultural or marine products, clothes or the like that are incorporated in the chamber may be dried efficiently and speedily due to the air pressure reduction effect as well as the air friction heat effect.

According to another aspect of this invention, outer air is supplied into the chamber by means of rotary outer air feeding means installed on the chamber so that the temperature within chamber can be set uniformly to achieve an effective drying.

According to another aspect of this invention, the outer air is additionally heated by heating means installed on the chamber in order to prevent a decrease in the chamber temperature, and the heating means is controlled manually or automatically in connection with the temperature within the chamber.

Other and further objects, features and advantages of this invention will appear more fully from the following description taken in connection with the accompanying drawings.

BRIEF DESCRIPTION OF THE ACCOMPANYING DRAWINGS

PREFERRED EXAMPLES OF THE INVENTION

Figure 1:
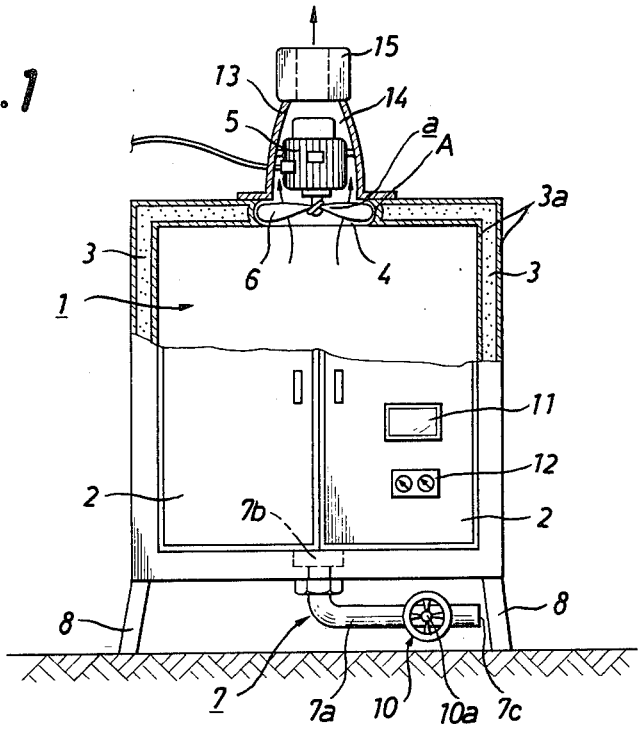
FIG. 1 is a partially cutaway front view of an example of a heating apparatus according to this invention.

A preferred example of a heating process and its apparatus according to this invention will now be described with reference to FIG. 1.

Numeral 1 is a square type chamber which is closed by a pair of doors 2, 2 for opening and closing. The chamber 1 is shielded by two external walls 3*a*, between which is incorporated a heat insulating material 3. Numeral 4 is a suction opening which is provided on a center of the chamber ceiling. In the suction opening 4 there is mounted rotary means a directly connected to a motor 5. The rotary means a is provided with a propeller fan or a silocco fan or the like, each of which has a plurality of vanes 6 rotatable by the motor 5. Each vane 6 has a certain inclination so that air within the chamber 1 can be suctioned and discharged smoothly.

Symbol A is a friction heat generating area where the rotary means a is rotated.

Numeral 7 is outer air feeding means comprising an outer air feeding pipe 7*a*. An opening end 7*b* of the feeding pipe 7*a* is directed to the bottom of the chamber 1. In FIG. 1 the chamber 1 is supported by legs 8 and the feeding pipe 7*a* is supported below a bottom wall of the chamber 1.

Numeral 10 is an adjusting valve of the outer air feeding pipe 7*a* and numeral 10*a* is a handle, by which the flow of outer air passing through the feeding pipe 7*a* can be adjusted. The adjusting valve 10 may be used as an automatic control valve which can variably control a working air pressure, taking into consideration a temperature within the chamber 1 and an air pressure difference between the inside of and the outside of the chamber 1. Therefore, the outer air is supplied into the chamber 1 in connection with the temperature of the chamber 1 or the air reducing condition therein.

Numeral 11 is a window for inspecting the chamber inside and numeral 12 is an indication panel on which are indicated the temperature, air pressure, etc. The motor 5 is shielded by a cylinder case 13 in which is formed a passage for discharging air. Numeral 15 is a silencer for eliminating noises. Further, to dry the wet articles incorporated in the chamber 1, a number of shelves (not illustrated) for placing them may be mounted therein. Needless to say, the shelves are perforated so as to obtain a ventilation effect.

Now, the heating process of this invention will be described.

When the motor 5 is energized, a plurality of vanes 6 are rotated and the air pressure within the chamber 1 is gradually reduced since the air therewithin is suctioned forcibly and discharged outside the chamber by rotation of a plurality of vanes 6. And a difference between a reduced air pressure within the chamber 1 and a normal air pressure thereoutside becomes larger gradually, but after a short lapse of time the difference therebetween is maintained at a balanced level. The air pressure difference is defined by a suction force of the rotary means a and a gap scale between the suction opening 4 and the rotary vanes 6, but the difference between the reduced air pressure within the chamber 1 and the normal air pressure thereoutside is maintained at a balanced level as long as the vanes 6 are rotated continuously.

In this balanced air pressure difference, an air retaining phenomenon is generated in the friction heat generating area A where the vanes 6 are rotated. Since the vanes 6 are rotated continuously in that area A, air friction heat is generated and its temperature is gradually raised. The thus heated friction air is spread throughout the chamber 1. And it is possible to heat the chamber 1 to the desired temperature.

Accordingly, when wet articles for drying are incorporated within the chamber 1, a wet or aqueous content in each article is evaporated highly by the air pressure reduction effect within the chamber 1. In addition to this, owing to the air friction heat effect, the chamber temperature is raised and all articles incorporated in the chamber are heated and the wet articles are dried uniformly and speedily.

Further, during the heating process of the chamber 1, when feeding outer air into the chamber 1 by opening the valve 10 of the outer air feeding pipe 7, the temperature within the chamber is decreased, but due to the outer air supply certain vapors within the chamber 1 are discharged thereoutside by rotation of the vanes 6 so that the drying effect in the chamber 1 can be expedited.

As described above, because a pump for feeding hot air or a heater for heating the chamber inside is not required, this invention can contribute a great saving of energy.

Figure 2:
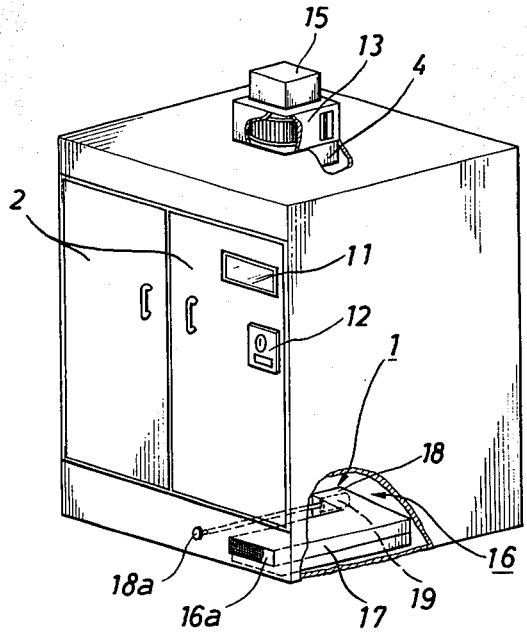
FIG. 2 is a partially cutaway perspective view of another example of the heating apparatus according to this invention.
Figure 3:
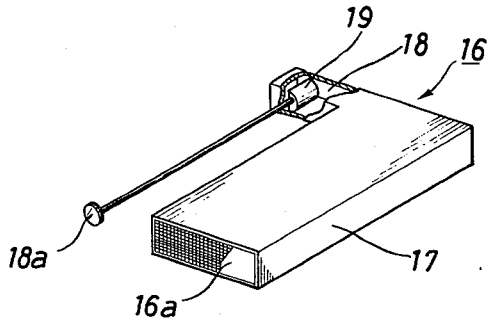
FIG. 3 is a partially cutaway perspective view of outer air feeding means of the heating apparatus in FIG. 2.
Figure 5:
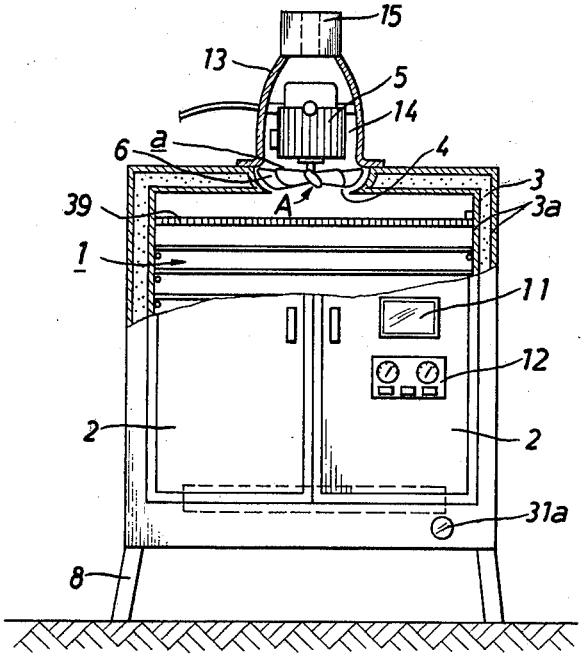
FIG. 5 is a partially cutaway front view of another example of the heating apparatus according to this invention.

An example in FIGS. 2 and 3 will now be described. A difference between the above example and this example is a technical structure of the outer air feeding means. The remainder of the structure is the same as the above example. The description of the same components as shown in FIG. 1 will be omitted. In FIG. 2, outer air feeding means 16 is incorporated in the bottom of the chamber 1. The outer air is suctioned from a suction opening 16*a* and is fed into an air passage 17 and a suction pipe 18 as well. A front end of the suction pipe 18 is a nozzle 19 which is controlled by a handle 18*a* projecting from a front panel of the chamber 1.

Figure 4:
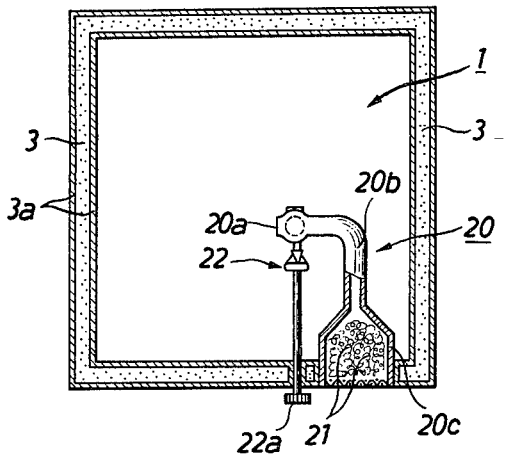
FIG. 4 is a partially cutaway section of an example of the outer air feeding means.

FIG. 4 is another example of the outer air feeding means. A passage 20*c* of outer air feeding means 20 is filled with a filtering material 21 which is replaceable, whereby dust is filtered from the outer air. An outer air feeding pipe 20*b* is communicated to an inner opening 20*a* directed to the chamber 1. The outer air is fed into the chamber 1 by opening a valve 22 with a handle 22*a*.

Another example of this invention will now be described with reference to FIGS. 5 to 11.

A construction in this example is basically the same as that in the example of FIG. 1. The example shown in FIGS. 5 to 11 comprises outer air feeding means, air flow regulating means, etc. Since the same construction as shown in FIG. 1 has the same numerals, its description will be omitted.

Figure 6:
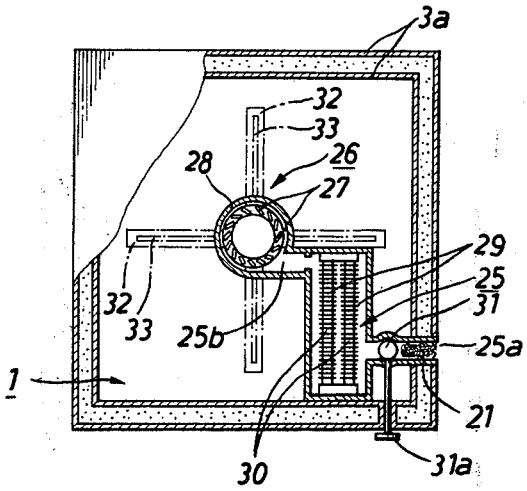
FIG. 6 is a partially cutaway section view showing the lower structure of the heating apparatus in FIG. 5.
Figure 9:
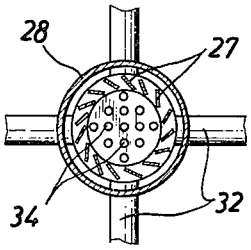
FIG. 9 is a section view taken on line IX—IX of FIG. 8.
Figure 7:
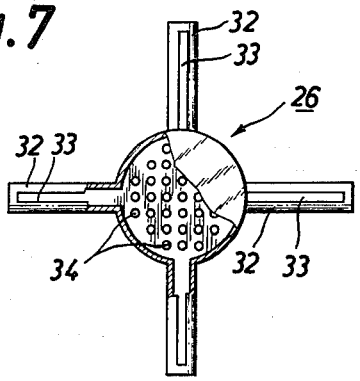
FIG. 7 is a partially cutaway plan view of rotary air feeding means in the above structure in FIG. 5.
Figure 8:
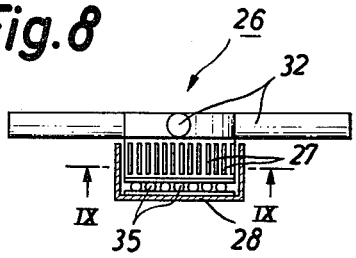
FIG. 8 is a side view of the rotary air feeding means in FIG. 7.

Numeral 25 is outer air feeding means mounted in the lower part of the chamber 1. An outer end 25*a* of the feeding means 25 is formed at one side of the outer walls 3*a*, while an inner end 25*b* thereof is formed at a silocco fan 27 which is positioned at a center of rotary air feeding means 26. As shown in FIG. 6, the silocco fan 27 is mounted within and around a cylinder 28. Further, a preferred number of heaters 30 each having a plurality of fins 29 are incorporated in the outer air feeding means 25. The heaters 30 perform the function of an additional heating device. The outer air supply is adjusted by manual operation of a handle 31*a* interconnected with an adjusting valve 31. The heaters 30 may be automatically controlled by a thermostat (not illustrated) so that the chamber 1 can be maintained at a constantly set temperature.

The adjusting valve 31 may be replaced with an automatic control valve which is opened or closed while detecting the chamber temperature or an air pressure difference between the inside of and the outside of the chamber.

Numerals 32 are a number of agitating cylinders which are provided in a radial direction. A slit-type opening 33 is formed on each agitating cylinder 32. The outer air by which the silocco fan 27 has been rotated is fed into a number of agitating cylinders 32 by way of a perforated disc 34 and discharged upwardly from the slit-type openings 33. Numeral 35 is a bearing mounted between the cylinder 28 and the silocco fan 27. Numeral 36 is air flow regulating means mounted on the rotary air feeding means 21. The air flow regulating means 36 comprises a plurality of sloping plates 37, and a gap g is formed between adjacent sloping plates 37.

Figure 11:
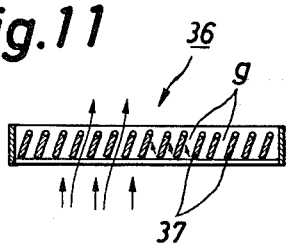
FIG. 11 is a section view taken on line XI—XI of FIG. 10.

As shown in FIG. 11, heated air is supplied to the chamber 1 along the inclination of each sloping plate 37 so as to obtain a uniform temperature throughout the chamber 1. Further, by adjusting the inclination of a plurality of sloping plates 37, it is possible to adjust the quantity of the air flow to be fed into the chamber 1.

Numeral 39 is a perforated plate which is supported at the upper part of the chamber 1 in order that the air in the chamber 1 may be suctioned uniformly from the whole area by rotation of the rotary means a. At the same time, in view of safe operation, the perforated plate 39 is mounted to cover the rotary means a which is exposed. Thus, it is impossible for any operator to touch the rotary means a directly.

Further, it is one's option to mount a number of shelves (partially illustrated) for supporting the articles for drying, but it is of course inevitable to provide the shelves with a ventilation effect.

A heating process of the above example will now be described.

As described previously, the air in the chamber is heated by the air pressure reduction effect of the rotary means as well as by the air friction heat effect thereof. In the example as shown in FIGS. 5 to 11, the air in the chamber 1 is first of all set at a desired temperature, and then the outer air feeding means 25 is operated. The outer air is supplied to the chamber 1 by adjusting the switch 31*a* of the adjusting valve 31 and then additionally heated by the heaters 30. And the temperature of the heated outer air is identical with or similar to that of the air within the chamber 1. The heated outer air is rotated by the rotary air feeding means 26 and uniformly fed into the chamber 1 by way of the air flow regulating means 31.

Accordingly, any wet articles that are incorporated in the chamber are heated and dried uniformly with the minimum energy consumption.

Figure 13:
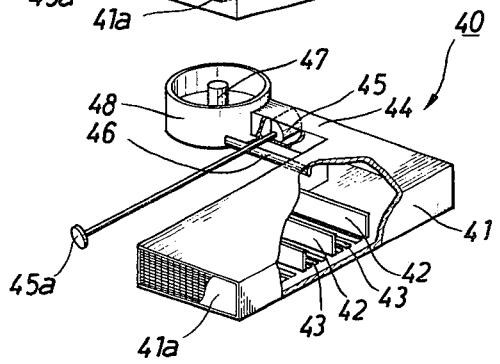
FIG. 13 is a partially cutaway perspective view of outer air feeding means mounted in the heating apparatus in FIG. 12.
Figure 14:
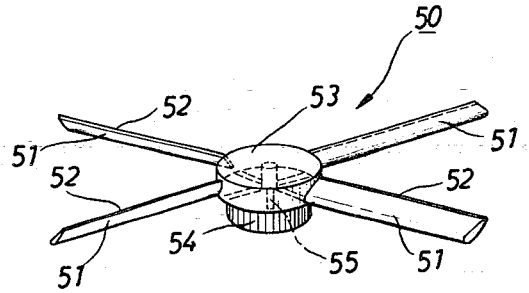
FIG. 14 is a perspective view of rotary air feeding means mounted in the heating apparatus in FIG. 12.

Now, a further example of this invention will now be described with reference to FIGS. 12 to 14.

A principle, function and operation of this example are identical with those in the aforementioned examples. Outer air feeding means 40 comprises an air passage 41, in which the outer air is introduced from an opening 41*a*. In the air passage 41 there are incorporated a number of heaters 43 which are partitioned by a number of baffle boards 42. The outer air suctioned into the passage 41 is inclined to remain in the passage 41 due to the baffle boards 42, so that the retained air is heated by the heaters 43. The air passage 41 is connected to a conduit 44 which is linked with a cylinder 48 having a pin 47 by way of an adjusting cock 45. The opening or closing of the cock 45 is done by operating a handle 45*a*. Numeral 46 is a by-pass pipe. The rotary air feeding means 50 having a cylinder case 54 is rotatably mounted in the cylinder 48. The rotary air feeding means 40 comprises a number of vanes 51, each of which is inclined obliquely. And each of the vanes 51 is provided at its top edge with a slit 52, from which the heated air is fed into the chamber 1. Due to a repulsion of the rotating vanes 51, the rotation of the cylindrical case 54 is expedited, thereby rotary air feeding means 50 is rotated smoothly. As a result, the heated air throughout the chamber 1 can be maintained at a constant temperature.

Figure 10:
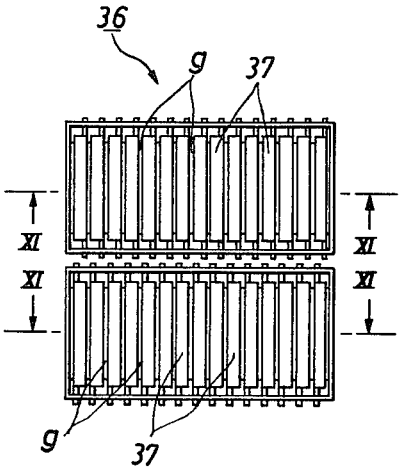
FIG. 10 is a plan view of air flow regulating means in its use condition.
Figure 12:
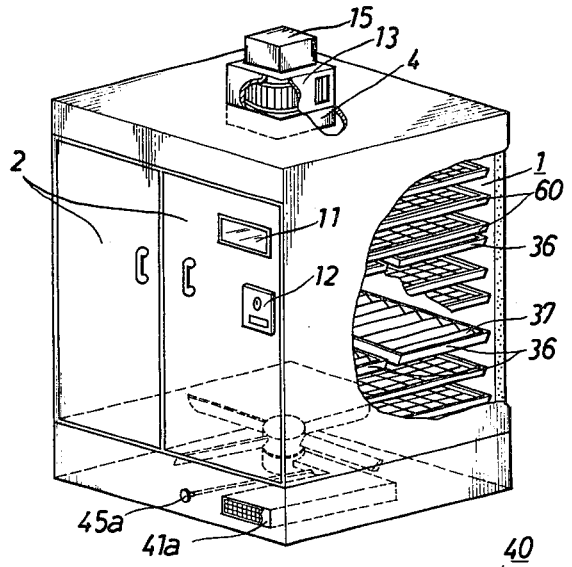
FIG. 12 is a partially cutaway perspective view of another example of the heating apparatus according to this invention.

As shown in FIG. 12, in the chamber 1 there are supported a plurality of perforated shelves 60 as well as a plurality of air flow regulating means 36 as shown in FIGS. 10 and 11. The opening or closing of the adjusting cock 45 may be done automatically by a timer (not illustrated). Further, air drawn through the by-pass pipe 46 may be effective as means for rotating the cylinder case 54.

As described previously, the air within a sealed chamber is first of all suctioned forcibly and discharged thereoutside by rotation of rotary means mounted on the chamber. Then, the air pressure therewithin gets reduced at a balanced level. Meanwhile, air friction heat is generated by a continuous rotation of the rotary means and the inside of the chamber is heated by the air friction heat. After the friction heat has reached a desirable temperature, preferably heated outer air may be supplied into the chamber by way of outer air feeding means having a heater in order to further enhance the drying effect of the chamber. At the same time, a certain quantity of vapor caused by the wet articles in the chamber may be discharged outside the chamber through the air suction opening.

Further, since the outer air feeding means is provided with the rotary air feeding means, the suctioned outer air is distributed uniformly throughout the chamber by rotation of the rotary air feeding means. Accordingly, the air in the chamber is maintained at a constant temperature throughout and wet articles therein are dried uniformly.

The heating system of this invention may be employed without using a conventional large heater and thereby may save the consumption of a large quantity of energy. A small size heater may optionally be included. Thus, energy consumption can be saved greatly. And various kinds of wet articles such as agricultural or marine products, clothes or the like in the chamber can be dried effectively and speedily.

As described previously, the rotary means for suctioning and discharging the air from the chamber is mounted on the top of the chamber, while the outer air feeding means and its related devices are mounted at the bottom thereof. However, the position of the former may be replaced with that of the latter.

Further, since heated air of high temperature is generated continuously and fully fills the chamber, the chamber itself becomes a heat source. Accordingly, such highly heated air can be used for various kinds of heaters such as a room heater, a hot water making device, a heater for a greenhouse, etc. Thus, the heating process and its apparatus according to this invention may be applied for various industrial fields.

As many apparently widely different embodiments of this invention may be made without departing from the spirit and scope thereof, it is to be understood that the invention is not limited to the specific embodiments thereof except as defined in the appended claims.

What is claimed is:

1. A heating process for heating the interior of a chamber at reduced air pressure, said chamber having an outlet, comprising:

forcibly suctioning air from within said chamber by rotary means at said outlet;

discharging forcibly suctioned air outside said chamber by rotation of said rotary means until air pressure within the chamber is reduced to a balanced level;

maintaining a difference between the reduced air pressure within said chamber and the air pressure outside said chamber at said balanced level;

generating air friction heat by continuous rotation of the rotary means, and permitting a substantial portion of said air friction heat to remain inside said chamber whereby said inside of said chamber is heated by the air friction heat at said reduced air pressure; and controlling a flow rate of air entering said chamber to a value effective to maintain a temperature of air remaining in said chamber at a predetermined level.

2. A heating process according to claim 1, wherein the process is effective to uniformly dry wet articles incorporated in the chamber.

3. A process according to claim 1, wherein the step of supplying a controlled outer air includes heating said outer air.

4. A process according to claim 1, wherein the step of controlling a flow rate of air includes automatically supplying said air in response to a condition in said chamber.

5. A heating apparatus for heating the interior of a chamber at reduced air pressure, said chamber having an air outlet comprising:

an air suction opening in said air outlet of said chamber;

rotary means mounted in said air suction opening effective to reduce air pressure in said chamber to a reduced balanced level by forcibly suctioning air from said chamber and discharging said air outside said sealed chamber;

an air friction heat generating means in a rotation area of the rotary means, said air friction heat generating means being effective to add heat to air remaining in said chamber;

means for maintaining said air pressure in said chamber at said reduced balanced level whereby air remaining in the interior of said chamber is heated by air friction heat at said reduced balanced air pressure; and said means for maintaining including means for controlling a flow rate of air entering said chamber to a value effective to maintain a temperature of air remaining in said chamber at a predetermined level.

6. A heating apparatus according to claim 5, wherein said means for controlling a flow rate of air includes additional heating means to heat said air to a preferred temperature.

7. A heating apparatus according to claim 5 or 6, wherein the chamber includes means for incorporating wet articles therein.

8. A heating apparatus according to claim 6, wherein said means for controlling a flow rate of air includes an air inlet and means for opening and closing said air inlet and said chamber includes an outer wall in which is incorporated a heat insulating material.

9. A heating apparatus according to claim 4, wherein the rotary means comprises a plurality of rotary vanes each having a preferred inclination.

10. A heating apparatus according to claim 5 or 6, wherein the means for controlling a flow rate of air includes rotary air feeding means within said chamber, said rotary air feeding means being rotated by the passage of air therethrough.

11. A heating apparatus according to claim 7, wherein said means for feeding outer air includes an air inlet and means for opening and closing said air inlet and said chamber includes an outer wall in which is incorporated a heat insulating material.

* * * * *